US011174644B2

(12) United States Patent
Cartwright-Taylor

(10) Patent No.: US 11,174,644 B2
(45) Date of Patent: Nov. 16, 2021

(54) HANDRAIL FOR STAIRCASE

(71) Applicant: Lesley Susan Pamela Cartwright-Taylor, Surrey (GB)

(72) Inventor: Lesley Susan Pamela Cartwright-Taylor, Surrey (GB)

( * ) Notice: Subject to any disclaimer, the term of this patent is extended or adjusted under 35 U.S.C. 154(b) by 613 days.

(21) Appl. No.: 16/078,116

(22) PCT Filed: Feb. 24, 2017

(86) PCT No.: PCT/GB2017/000026
§ 371 (c)(1),
(2) Date: Aug. 21, 2018

(87) PCT Pub. No.: WO2017/144842
PCT Pub. Date: Aug. 31, 2017

(65) Prior Publication Data

US 2021/0189735 A1 Jun. 24, 2021

(30) Foreign Application Priority Data

Feb. 25, 2016 (GB) ..... 1603347

(51) Int. Cl.
*E04F 11/18* (2006.01)

(52) U.S. Cl.
CPC ..... *E04F 11/1802* (2013.01); *E04F 11/1836* (2013.01); *E04F 11/1861* (2013.01); *E04F 2011/1806* (2013.01); *E04F 2011/1872* (2013.01)

(58) Field of Classification Search
CPC ... E04F 11/18; E04F 11/1802; E04F 11/1808; E04F 11/1836; E04F 11/1861; E04F 11/1863; E04F 11/1838; E04F 2011/1868; E04F 2011/187; E04F 2011/1806; E04G 5/142
See application file for complete search history.

(56) References Cited

U.S. PATENT DOCUMENTS 3,269,553 A * 8/1966 Ruhnke ..... A47B 61/003 211/105.1
3,286,850 A * 11/1966 Ruhnke ..... A47B 61/003 211/105.1
3,995,832 A * 12/1976 Wiese ..... E04H 3/123 256/59
4,556,201 A * 12/1985 Turner ..... E04F 11/1863 248/251
5,551,194 A * 9/1996 Toomey ..... E04F 11/1863 256/65.16
5,657,968 A 8/1997 Marsden
5,853,166 A 12/1998 Koza
5,913,508 A * 6/1999 Eades ..... E04G 5/142 256/65.06

(Continued)

FOREIGN PATENT DOCUMENTS

CN 203238870 U * 10/2013
CN 203640181 U * 6/2014

(Continued)

*Primary Examiner* — Ryan D Kwiecinski
(74) *Attorney, Agent, or Firm* — David Guerra

(57) ABSTRACT

The invention relates to a handrail for a staircase comprising a handrail member and an adjustable securement device (80, 85) to support the hand rail member at variable heights above the stairs of a staircase.

17 Claims, 8 Drawing Sheets

(56) References Cited

U.S. PATENT DOCUMENTS

| | | | | |
|---|---|---|---|---|
| 8,757,566 | B2 * | 6/2014 | Nash | E04F 11/1804 248/201 |
| 10,407,916 | B1 * | 9/2019 | Samad | E04F 11/1834 |
| 2008/0209853 | A1 * | 9/2008 | Hull | E04F 11/1863 52/832 |

FOREIGN PATENT DOCUMENTS

| | | | |
|---|---|---|---|
| JP | 2001317173 | A | 11/2001 |
| JP | 2005282318 | A | 10/2005 |
| JP | 2005307600 | A | 11/2005 |

* cited by examiner

HANDRAIL FOR STAIRCASE

CROSS-REFERENCE TO RELATED APPLICATIONS

This application is an U.S. national phase application under 35 U.S.C. § 371 based upon co-pending International Application No. PCT/GB2017/000026 filed on Feb. 24, 2017. Additionally, this U.S. national phase application claims the benefit of priority of co-pending International Application No. PCT/GB2017/000026 filed on Feb. 24, 2017 and Great Britain Application No. 1603347.4 filed on Feb. 25, 2016. The entire disclosures of the prior applications are incorporated herein by reference. The international application was published on Aug. 31, 2017 under Publication No. WO 2017/144842 A1.

TECHNICAL FIELD

The present invention relates to a handrail for a staircase.

BACKGROUND DESCRIPTION

Most staircases have a handrail on one or both sides of the staircase to help stabilise a person's balance walking up or down stairs. Most handrails are set at a height suitable for adults. If a small child attempts to climb up or down a staircase the normal handrail is out of arm's reach, and does not provide a means of stability causing the child to be unstable in both ascent and decent and could lead to a child falling down the stairs.

SUMMARY

According to the present invention there is provided a handrail for a staircase comprising a handrail member and an adjustable securement device to support the hand rail member at variable heights above the stairs of a staircase.

In one embodiment the adjustable securement device supports the handrail member at variable heights to an existing handrail. The adjustable securement device may include at least one tie which secures to an existing handrail and at least one clamp member secured to the handrail member which clamps to a tie at various positions along the length of the tie.

In another embodiment the adjustable securement device supports the handrail member at variable heights to an existing substantially vertical surface adjacent the staircase. The adjustable securement device may include at least one track and track follower, each track follower supporting the handrail member and each track follower being adapted to secure itself at various positions on the track.

In one embodiment the track follower may include a cam shape which locks to opposing surfaces of the track when rotated in one direction and unlocks from the track when rotated in the other direction.

In another embodiment the track may include a plurality of vertically spaced horizontal grooves or apertures and track follower may include at least one horizontal bar or bolt and the or each bar or bolt engages into a groove or aperture on the track. The track follower may be formed in the image of a character such as a climber.

The track may also have a vertical groove along which the track follower may be secured at any height by bolts through apertures in the base of the track follower.

In one embodiment the track has a front face with an elongate aperture leading into a widened cavity and the track follower has a base with an aperture and a handrail support bracket spaced by an arm from the base, said base being secured to the track front face with a fastener passing through the base aperture and having a head which slides in the widened cavity and can engage with the rear of the front face, the track follower being securable at variable positions along the track. Preferably the fastener is a single axis fastener, with the angle of the support bracket relative to the track being adjustable by rotating the track follower relative to the track.

Preferably the single axis fastener is a bolt. Preferably the arm has an opening allowing access to the fastener in the base aperture. Preferably the ends of the track have an aperture to receive a fastener to secure the track to a wall or bannister.

The handrail member may be adjustable in length to suit different lengths of stairs. The handrail member may be made of a number of equal length interconnecting sections and one or more telescopic sections.

The invention also extends to a handrail with an audible sound operated by a child's hand touching the rail. The audible sound may increase in pitch and/or volume the higher the child is up the stairs. The audible sound may be customised. The handrail may include features of the handrail member defined above.

The invention also extends to a handrail incorporating one or more lights such as LEDs. The lights may be operated by a child's hand touching the handrail. A string of lights may be provided along the handrail above to follow a child up the stairs in sequence. The or each light may illuminate a staircase. The handrail may include features of the handrails defined above.

BRIEF DESCRIPTION OF THE DRAWINGS

Embodiments of the invention will now be described with reference to and as shown in the accompanying drawings in which.

DETAILED DESCRIPTION OF THE PREFERRED EMBODIMENTS

Figure 1:
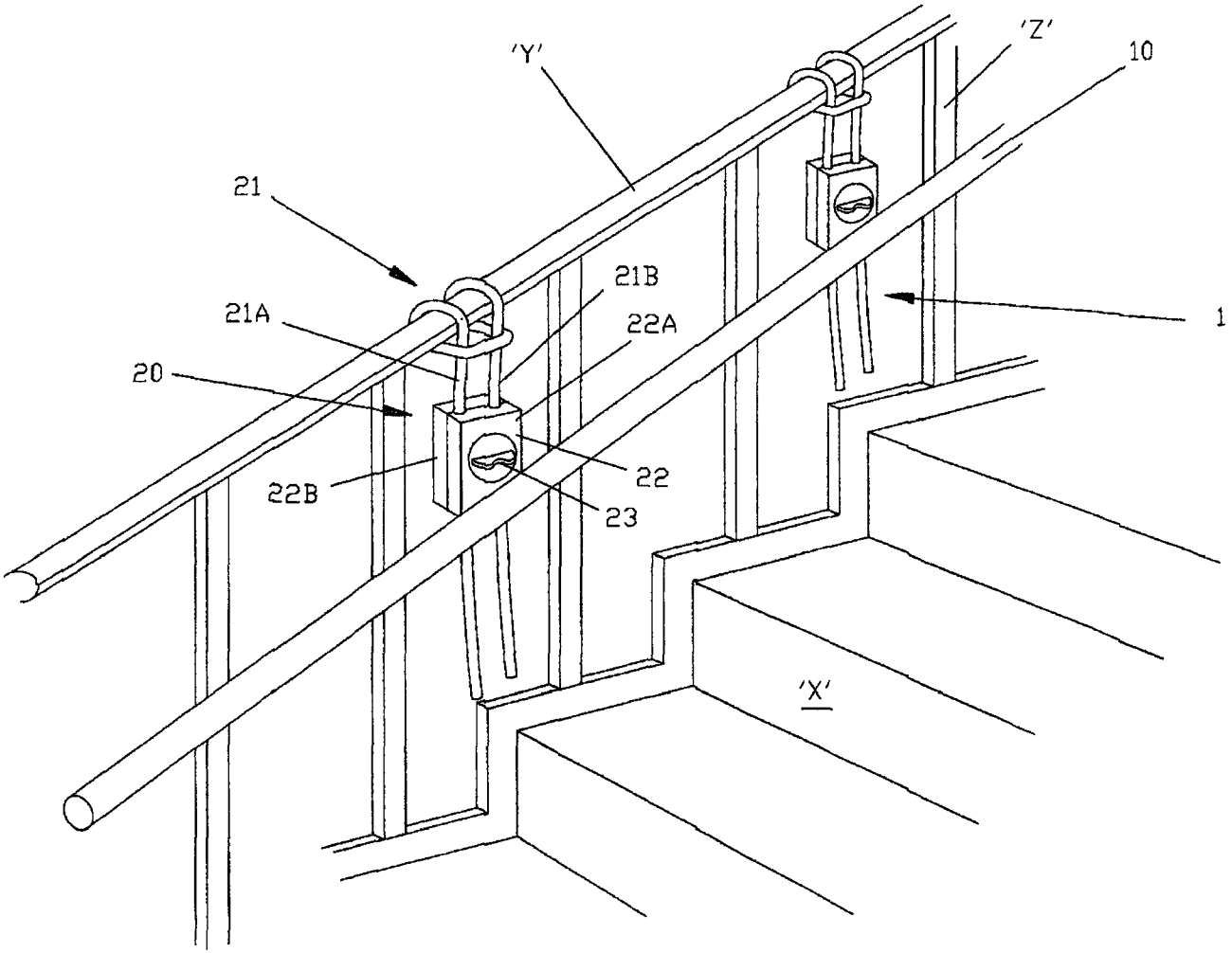
FIG. 1 shows a perspective view of a first embodiment.

Referring to FIG. 1 there is shown a handrail 1 for a staircase X with an existing handrail Y spaced from the staircase by banisters Z.

An elongate handrail member 10 is provided for securement to existing handrail Y at variable heights by means of an adjustable securement device 20 above the stairs of a staircase X. Handrail member 10 may be of a dimension appropriate for a child's hand.

Device 20 has a tie in the form of a loop of cord 21 providing two side by side lengths 21A, 21B, e.g. made of rope. A clamp member 22 is secured to the handrail member 10 which clamps to a tie at various positions along the length of the tie. Clamp 22 comprises two shells 22A, 22B which can be tightened together by rotating a locking nut 23.

It is envisaged that a plurality of devices 20 would be connected to handrail member 10 to secure member 10 to the existing rail Y at various points along their lengths. The height of member 10 relative to existing rail Y can be adjusted as desired using the clamps 22.

Figure 2:
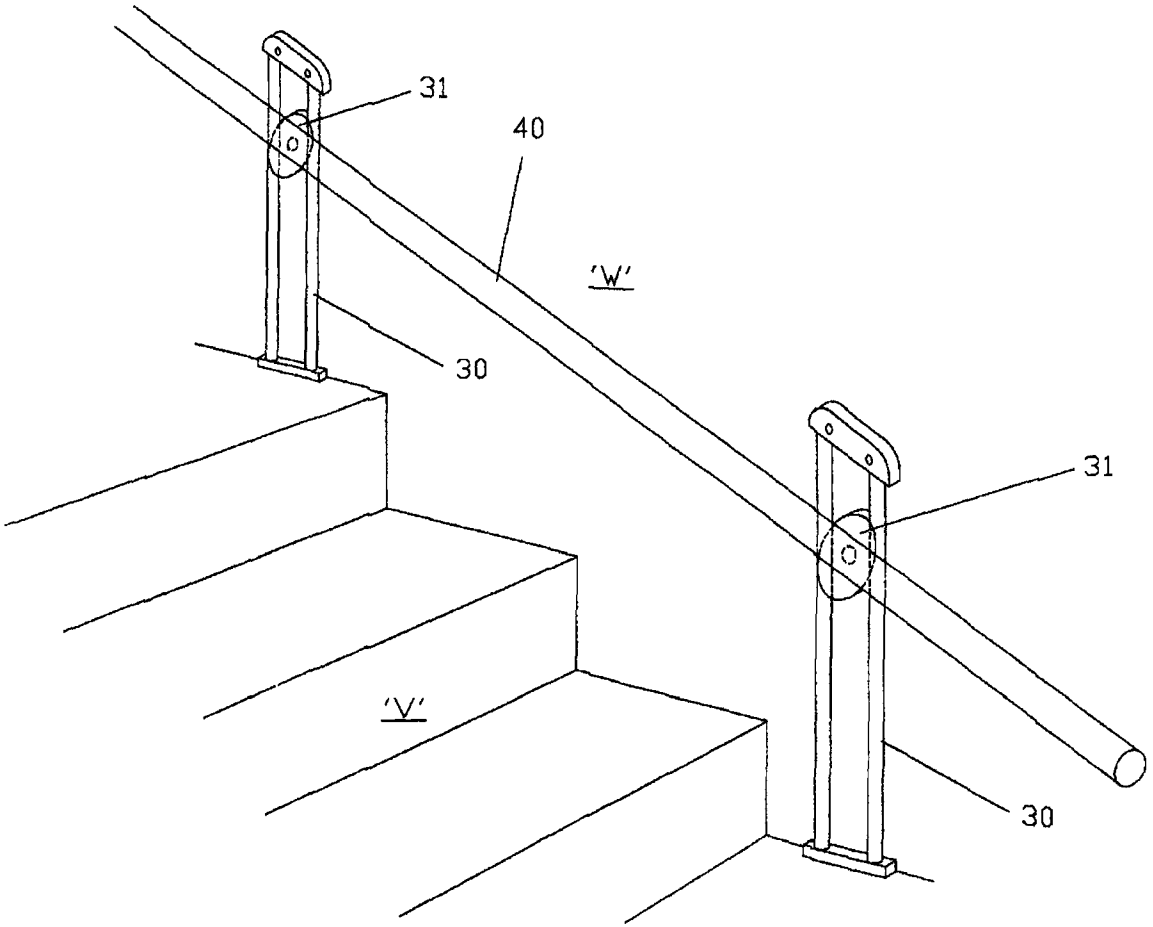
FIG. 2 shows a perspective view of a second embodiment.

Referring now to FIG. 2, there is shown an existing staircase V and an existing substantially vertical wall surface W adjacent the staircase V.

A plurality of U-shaped tracks 30 is provided which can be secured vertically against wall surface W. A track follower for each track 30 is provided in the form of an elliptical cam wheel 31 slides up and down a track. Each wheel 31 locks to opposing surfaces of its track 30 when rotated in one direction and unlocks from its track when rotated in the other direction. Each wheel 31 can thus be locked in variable position along the track. Each wheel is secured to a handrail member 40. Each track 30 could be secured to the wall (or a banister under an existing stair handrail) by means of permanent fixings such as screws, or by a non permanent fixing such as adhesive so that a track could be removed without soiling the wall.

In use handrail member 40 can be adjusted in height as required.

Figure 3A:
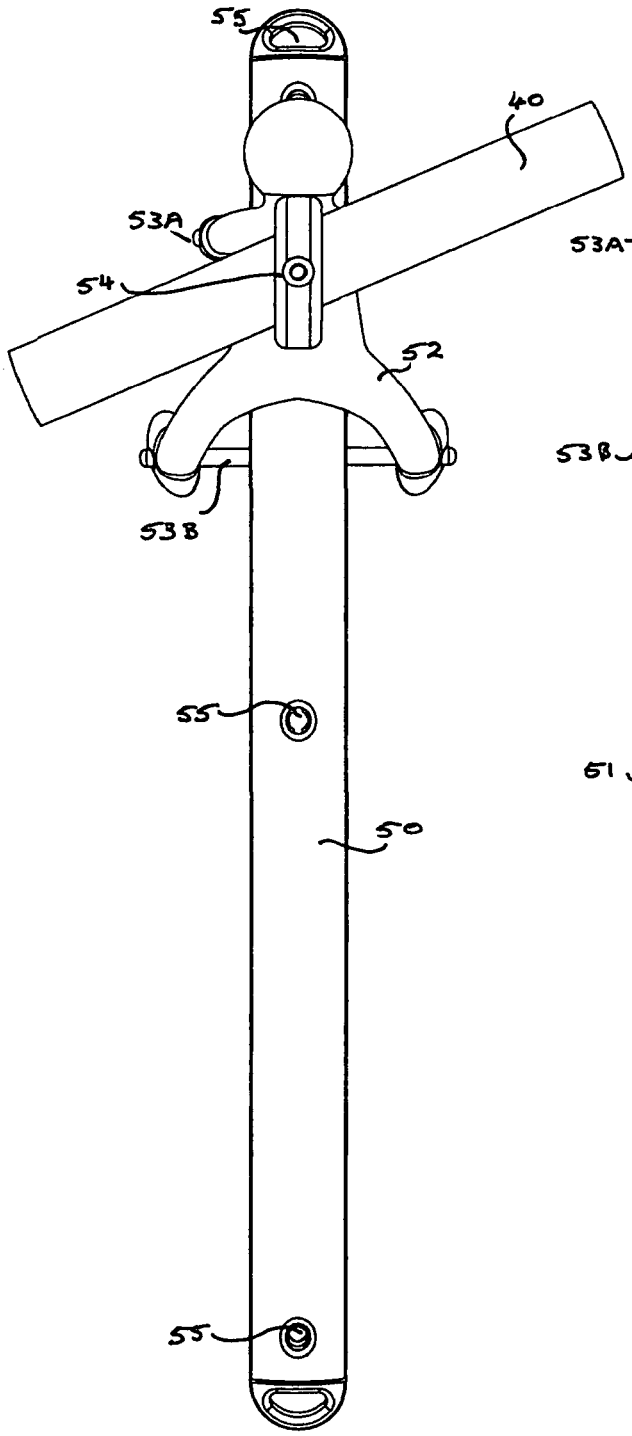
FIGS. 3A and 3B, 4A-C, 5, 6A-C and 7 show perspective views of a third embodiment.
Figure 3B:
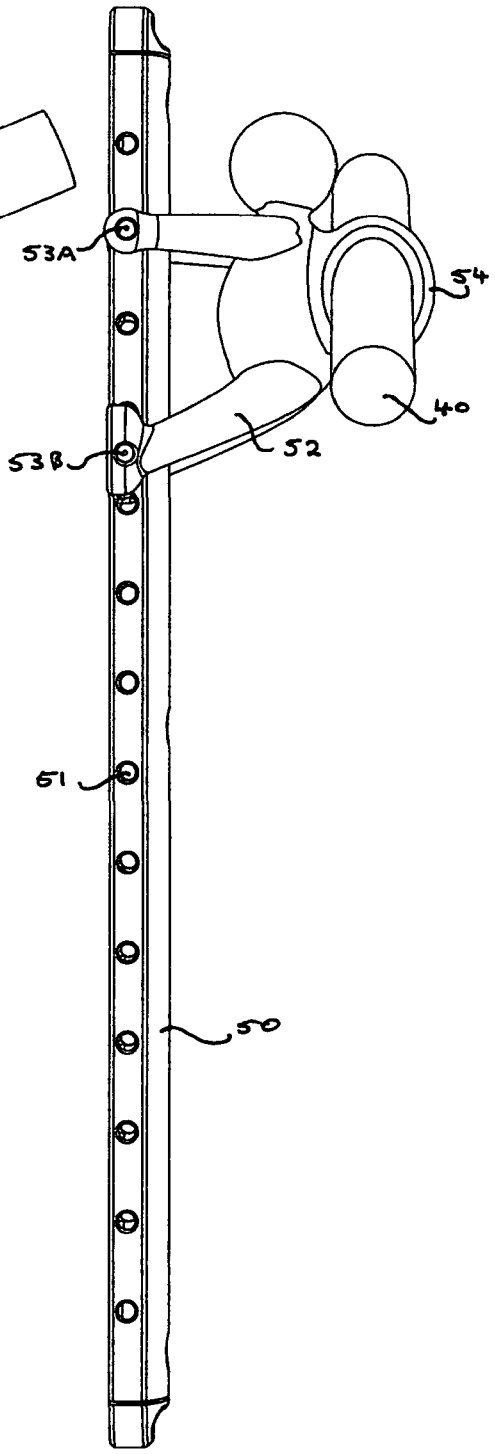

Referring now to FIGS. 3A and 3B, instead of tracks 30 and track follower 31, a track 50 is provided with a plurality of vertically spaced horizontal recessed apertures 51 along at least part of the length of the track 50. A track follower is provided in the form of a body 52 shaped like a climber with arms supporting a removable horizontal bar 53A and legs supporting a removable horizontal bar 53B. Body 52 supports a bracket 54 to connect to handrail 40. In use the bars 53A, 53B can be used to lock body 52 in variable positions along the track to adjust the height of handrail 40. This is done by could done by removing the bars 53A, 52B from an arm and leg on one side of the body 52, and sliding bars 53A, 53B through the desired apertures 51 so they re-engage with the arms and legs on said one side of the body 52.

Instead of bars 53A, 53B releasably engaging in recessed apertures, the bars could be fixed to the body 52 and engage in vertically spaced horizontal grooves.

Each track 50 could be secured to the wall (or a banister under an existing stair handrail) by means of permanent fixings such as screws passing through apertures 55, or by a non permanent fixing such as adhesive so that a track could be removed without soiling the wall.

Figure 4A:
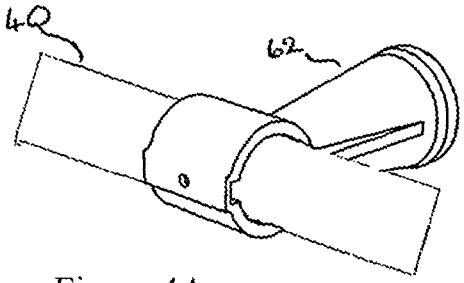
Figure 4B:
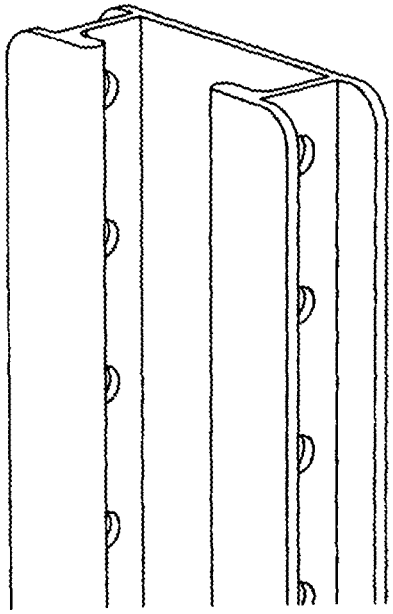
Figure 4C:
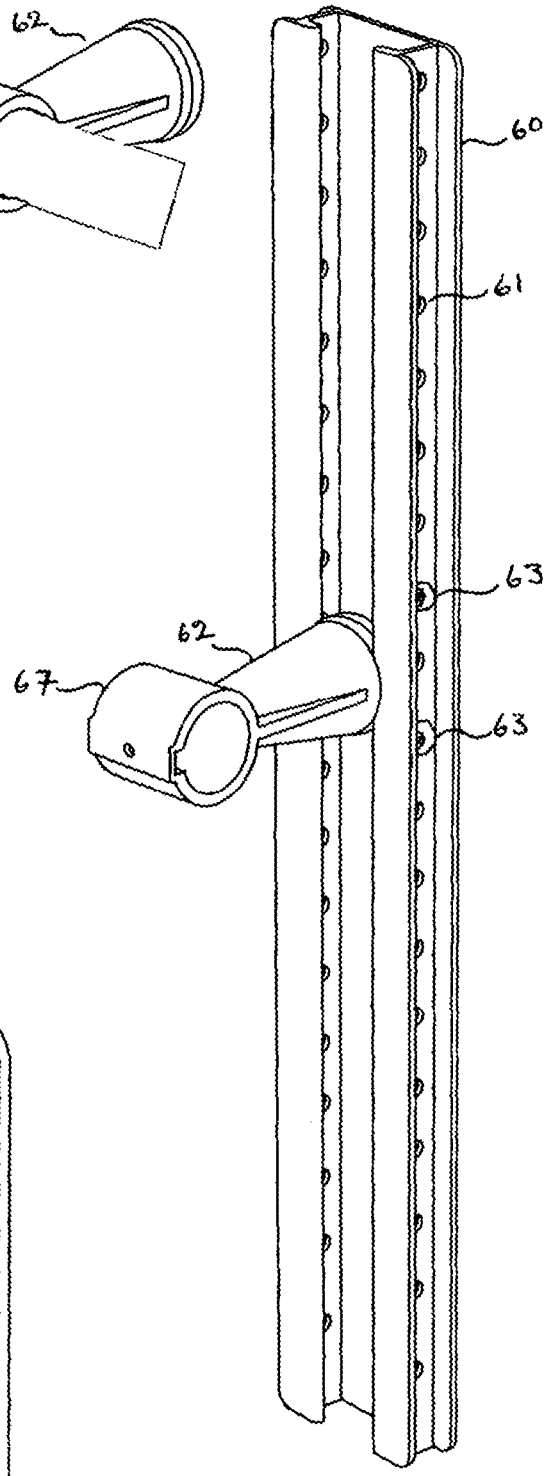

Referring now to FIGS. 4A, 4B and 4C, an alternative track, 60, is provided with a vertical groove and a plurality of vertically spaced horizontal recessed apertures, 61, along at least part of the length of the track 60. A track follower is provided in the form of a rail bracket, 62, with, at one end, a circular shape that can slide down the vertical groove, and can be supported by a removable horizontal bar or bolt or bar with a quick release clip, 63, below and secured by a second similar removable bar or bolt above. In use the bar or bolt, 63, can be used to lock body 62 in variable positions along the track to adjust the height of handrail, 40. The track follower, 62, has a bracket, 67, to connect to handrail, 40.

Figure 5:
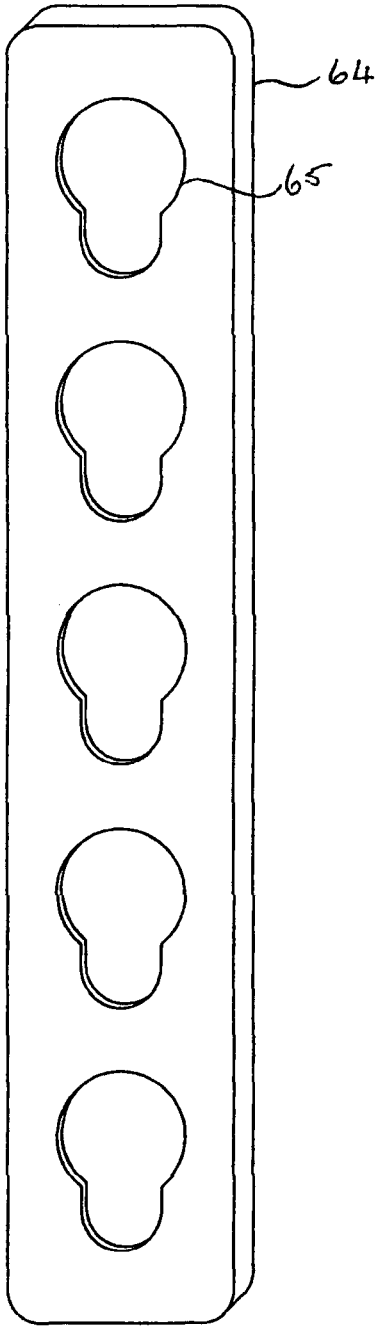

Referring now to FIG. 5 an alternative track, 64, for the third embodiment could be with a plurality of apertures, 65, in the front face to allow the track follower, 62, to slide in and sit in place.

Figure 6A:
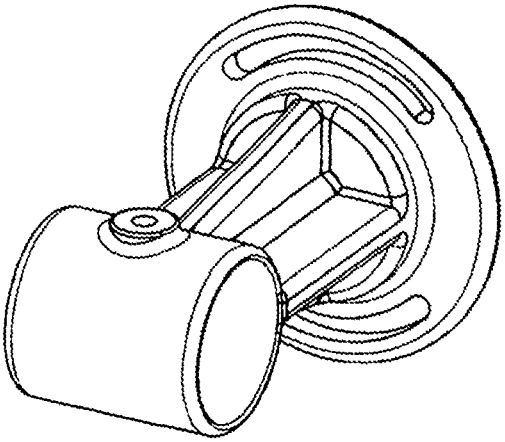
Figure 6C:
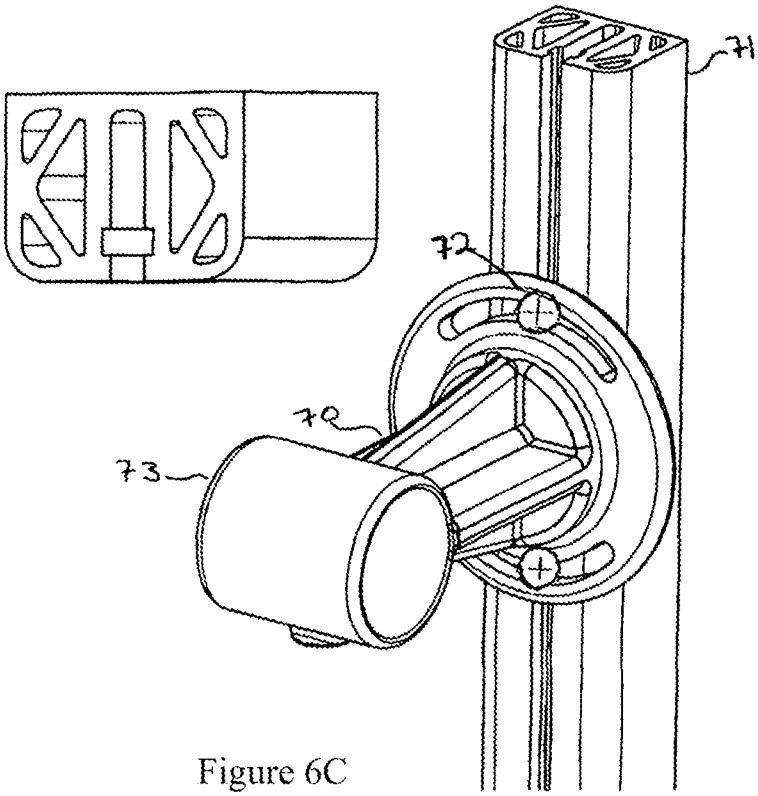
Figure 6B:
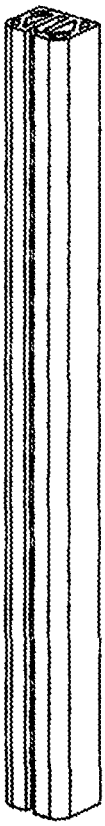

Alternatively, as shown in FIGS. 6A, 6B and 6C, the track follower, 70, may be supported at the front face of the track, 71, by bolts, 72, securing it to the track through slots in the base of the track follower, 70, at any height along the track, 71. The track follower, 70, has a bracket, 73, to connect to handrail, 40.

Figure 7:
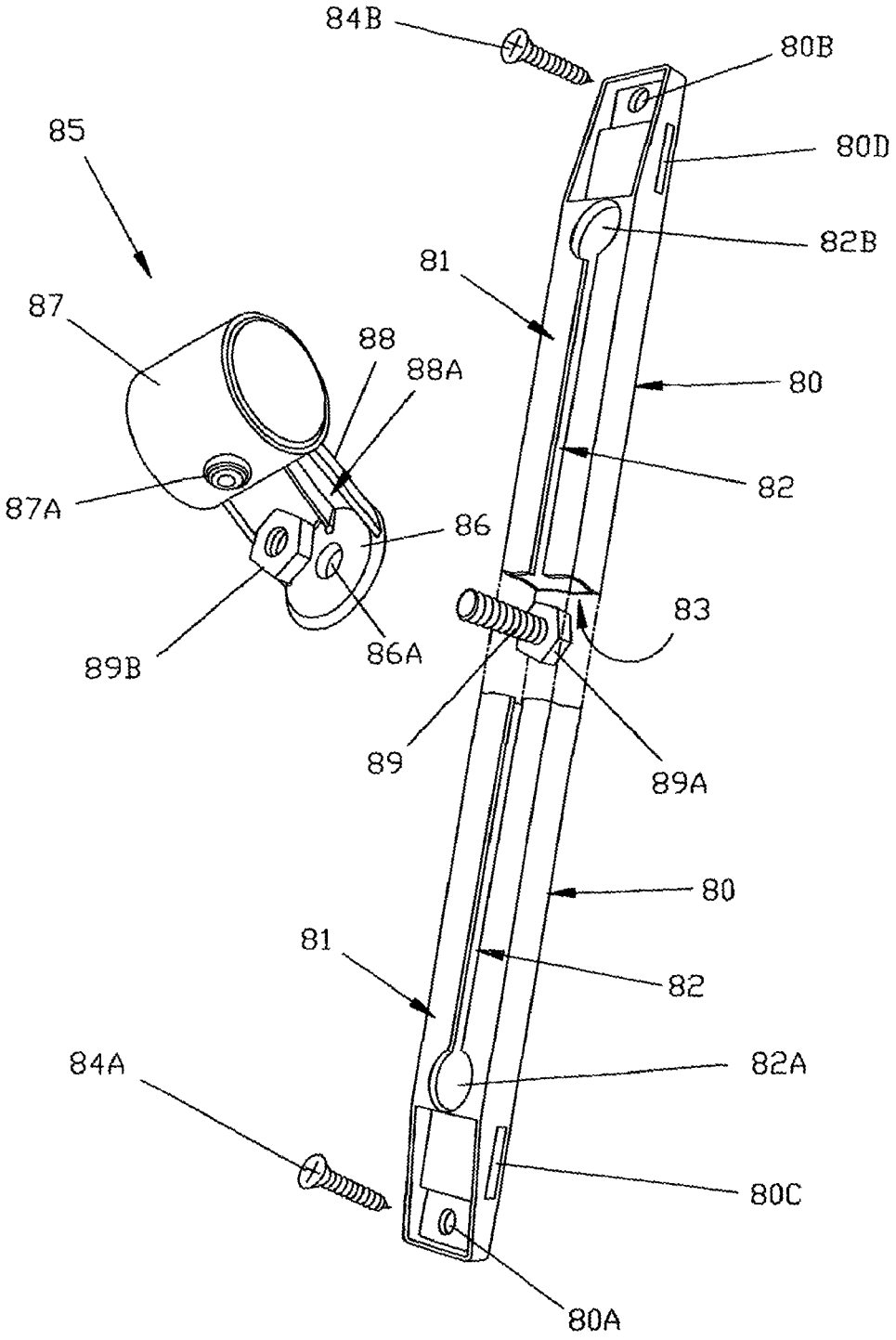

Referring now to FIG. 7 there is shown a track 80 (shown cut in half) having a front face 81 with an elongate aperture 82 leading into a widened C-shaped cavity 83. The ends 82A,82B of aperture are enlarged to take a bolt head, and the ends of the track have apertures 80A,80B to receive fasteners such as screws 84A,84B to secure the track vertical to a wall or banister. Also apertures in the form of slots 80C,80D could be provided to receive fasteners in the form of straps to secure the track to a bannister/handrail.

A track follower 85 has a base 86 with an aperture 86A and a tubular handrail support bracket 87 (with a fastener aperture 87A) spaced from the base by an arm in the form of a semi-circular tube 88. Base 86 is secured to the track front face 81 with a single axis fastener in the form of a bolt 89 passing through the base aperture and having a head 89A which slides in the widened cavity and can engage with the rear of the front face 81. A nut 89B can be tightened to secure the base 86 to the front face 81 at any point along the track to secure the track follower at variable positions along the track.

Because the bolt is a single axis fastener, with the angle of the support bracket relative to the track can be adjusted by rotating the track follower relative to the track so that a handrail connected to the support bracket can be supported at any desired angle relative to stairs.

Because the arm is a semi-circular tube 88, it creates an opening 88A allowing access to the nut 89B on the bolt passing through the base aperture 86A.

Figure 8:
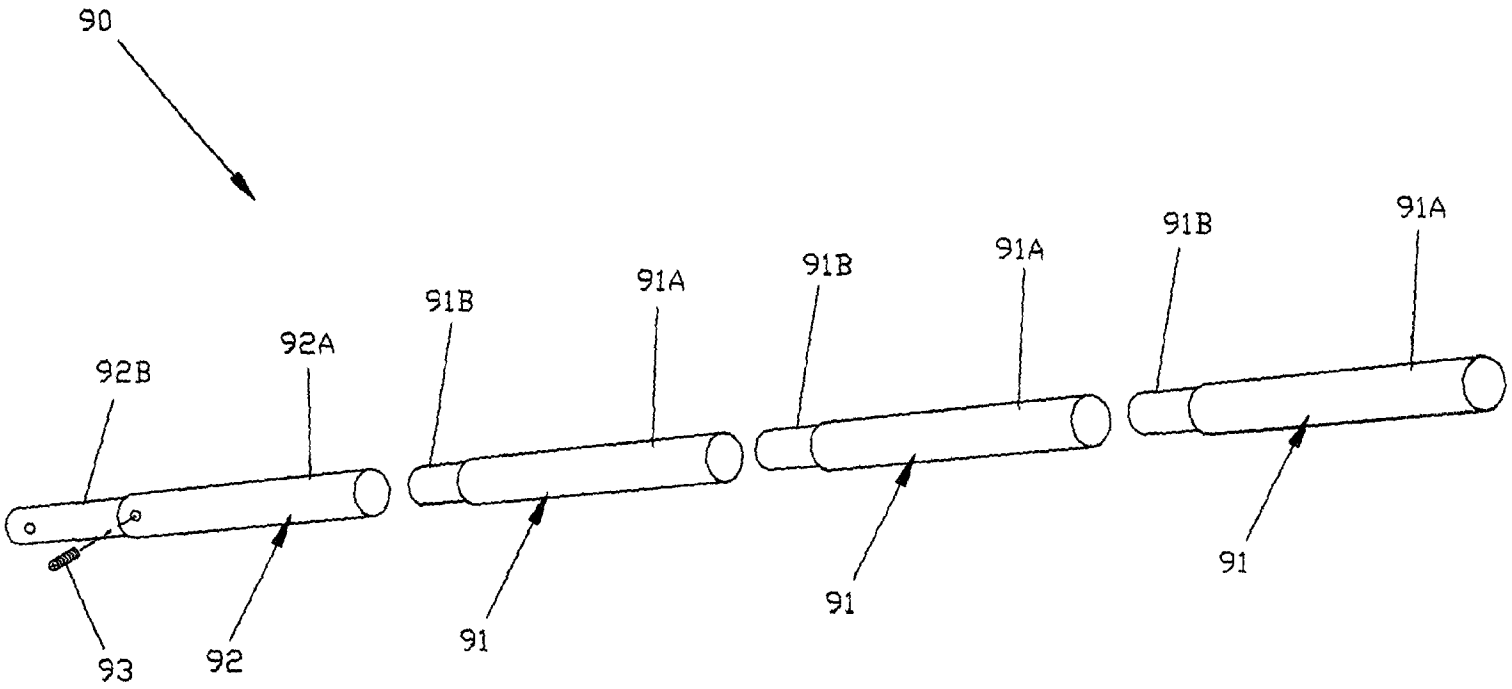
FIG. 8 shows a perspective view of a handrail member that is adjustable in length.

As shown in FIG. 8, a handrail includes a handrail member 90 which may be adjustable in length to suit different lengths of stairs. In order to make it adjustable in length and more convenient to transport or package and stock in a store, handrail member 90 may be made of a number of equal length interconnecting sections 91 and one or more telescopic sections 92. Each equal length section may have a wider body section 91A with a narrower tail end 91B which fits into the wider end of an adjacent section. A telescopic section 92 is made up of two telescoping tubes 92A,92B. Telescoping tube 92A is equal in diameter to the wider body section 91A and telescoping tube 92B is equal in diameter to narrow tail end 91B. The two telescoping tubes may be secured together by a grub screw 93. It is envisaged that the handrail member could be sold with more than enough numbers of fixed and telescoping sections to create the maximum length possible of a handrail member. The user can then select a sufficient number of fixed length sections and one or more telescoping section to create the exact length of handrail member required. The sections can be interconnected and then secured together using a grub screw (not shown), or the joints between sections could be held and covered in the tubular support brackets 87 using a fastener passing through aperture 87A (see FIG. 7). End plugs (not shown) may be provided for the ends of the assembled handrail member.

As in the third embodiment each track, 60, 66, 71 and 76 could be secured to the wall (or a banister under an existing stair handrail) by means of permanent fixings such as screws passing through apertures in the track or by a non-permanent fixing so that a track could be removed without soiling the wall.

The handrail member 10, 40, 90 described above could include an audible sound operated by a child's hand touching the rail. The audible sound may increase in pitch and/or volume the higher the child is up the stairs. The audible sound may be customised, e.g. with a child's favourite tune. This would alert parent of a child walking up or down the stairs that a child was on the stairs and a pitch or volume change could indicate a direction of travel either up or down the stairs. The invention thus also extends to a handrail with an audible sound operated by a child's hand touching the rail. The audible sound could be produced by a circuit with a "resistive ladder" extending along the rail similar to a keypad, or by a captive touch sense method. Also the rail could be a hollow extrusion with the circuit possible mounted in the extrusion. The circuit could be interchangeable and upgradeable.

The handrail member 10, 40, 90 described above could include one or more lights such as LEDs to illuminate the handrail and staircase for a child at night. The lights may be operated by a child's hand touching the handrail. A string of lights may be provided along the handrail above to follow a child up the stairs in sequence. The invention thus also extends to a handrail incorporating one or more lights such as LEDs.

The invention may take a form different to that specifically described above. For example two handrails could be supported by the same adjustable securement device at different heights for children of different sizes, for example each track could support two track followers. A silicone membrane may lie on top of the rail to give the rail non-slip properties and/or act as the compliance to activate the resistive ladder (Keypad).

Further modifications will be apparent to those skilled in the art without departing from the scope of the present invention.

The invention claimed is:

1. An adjustable handrail system for a staircase, said adjustable handrail system comprising:

at least one track attachable to a substantially vertical surface, said track includes a front face with an elongate aperture leading into a widened cavity;

a handrail member; and at least one track follower including a handrail bracket portion, a track bracket portion including a base, and an arm attaching said handrail bracket portion to said base, said handrail bracket portion being configured to securably receive a portion of said handrail member, said base defining a base aperture therethrough, and said handrail bracket portion being spaced from said base by said arm;

wherein said base being securable to said track front face with a fastener passing through said base aperture and having a head configured to slide in said widened cavity and is engageable with a rear of said front face, said track follower being securable at variable positions along said track;

wherein said track being configured to support said track follower at variable heights above a staircase;

wherein said arm is a semi-circular tube including a rib extending interiorly into an opening defined by said semi-circular tube, said rib being parallel with a longitudinal axis of the said semi-circular tube.

2. The adjustable handrail system according to claim 1, wherein said track supports said handrail member at variable heights to an existing handrail.

3. The adjustable handrail system according to claim 1, wherein said track follower supporting said handrail member is configured to be securable at various positions on said track.

4. The adjustable handrail system according to claim 1, wherein said track includes slots defined through a side of said track configured to receive straps to secure said track to a banister or handrail.

5. The adjustable handrail system according to claim 1, wherein said fastener is a single axis fastener, with an angle of said handrail bracket relative to said track being adjustable by rotating said track follower relative to said track.

6. The adjustable handrail system according to claim 5, wherein said single axis fastener is a bolt.

7. The adjustable handrail system according to claim 1, wherein said arm defines an opening allowing access to said fastener in said base aperture of said base.

8. The adjustable handrail system according to claim 1, wherein ends of said track define an aperture to receive a fastener to secure said track to the vertical surface.

9. The adjustable handrail system according to claim 1, wherein said handrail member is adjustable in length.

10. The adjustable handrail system according to claim 9, wherein said handrail member is made of a plurality of equal length interconnecting sections, and one or more telescopic sections.

11. The adjustable handrail system according to claim 1, wherein said handrail member is configured to generate an audible sound operated by touching said handrail member by a user.

12. The adjustable handrail system according to claim 11, wherein said audible sound increases in at least one of pitch and volume dependent on a location of touching of said handrail member.

13. The adjustable handrail system according to claim 12, wherein said handrail member includes a resistive ladder configured or configurable to determine the location of touching.

14. The adjustable handrail system according to claim 11, wherein said handrail member including one or more lights.

15. The adjustable handrail system according to claim 14, wherein said lights are operated by touching said handrail member by the user.

16. The adjustable handrail system according to claim 15, wherein said lights is a string of lights provided along a bottom side of said handrail member configured to illuminate the staircase, and said string of lights are configured or configurable to be illuminated in sequent corresponding to locations of the touching on said handrail member.

17. The adjustable handrail system according to claim 1, wherein said opening of said semi-circular tube is configured to allow access to a nut engageable with the fastener passing through said base aperture.

* * * * *